US009629476B1

(12) United States Patent
Robbins et al.

(10) Patent No.: US 9,629,476 B1
(45) Date of Patent: Apr. 25, 2017

(54) CONVERTIBLE CHILD SEAT

(71) Applicant: Graco Children's Products Inc., Atlanta, GA (US)

(72) Inventors: Chad Robbins, Atlanta, GA (US); Jon Hee Lee, Atlanta, GA (US)

(73) Assignee: Graco Children's Products Inc., Atlanta, GA (US)

( * ) Notice: Subject to any disclaimer, the term of this patent is extended or adjusted under 35 U.S.C. 154(b) by 154 days.

(21) Appl. No.: 14/735,740

(22) Filed: Jun. 10, 2015

Related U.S. Application Data

(60) Provisional application No. 62/009,913, filed on Jun. 10, 2014.

(51) Int. Cl.
*A47D 9/00* (2006.01)
*A47D 9/02* (2006.01)
*A47D 1/00* (2006.01)

(52) U.S. Cl.
CPC ..... *A47D 9/005* (2013.01); *A47D 1/002* (2013.01); *A47D 9/00* (2013.01); *A47D 9/02* (2013.01)

(58) Field of Classification Search
None
See application file for complete search history.

(56) References Cited

U.S. PATENT DOCUMENTS 4,577,355 A * 3/1986 Kassai ..... B62B 7/123 280/47.4
4,602,395 A * 7/1986 Kassai ..... B62B 7/123 280/47.4
4,616,371 A * 10/1986 Kassai ..... A47D 7/007 280/643
4,741,056 A * 5/1988 Kassai ..... B62B 7/123 280/47.4
8,657,326 B2 * 2/2014 Shaanan ..... B62B 7/142 280/47.38
8,746,794 B2 6/2014 Oren et al.
8,936,267 B2 * 1/2015 Li ..... B62B 7/00 280/30
2005/0210580 A1 * 9/2005 Clapper ..... A47D 9/00 5/93.1
2012/0235450 A1 * 9/2012 Oren ..... A47D 13/102 297/183.6
2014/0319884 A1 * 10/2014 Doucette ..... B62B 7/00 297/118

OTHER PUBLICATIONS

Fisher-Price Rock 'n Play Sleeper Manual, 2009, www.fisher-price.com, pp. 8.
Tiny Love 3-in-1 Rocker Napper, date unknown, www.tinylove.com, pp. 36.

* cited by examiner

*Primary Examiner* — David E Allred
(74) *Attorney, Agent, or Firm* — Eversheds Sutherland (US) LLP

(57) ABSTRACT

A convertible child seat has a frame assembly and a seat structure supported by the frame assembly. The seat structure defines a seating surface and is movable between at least an inclined seating position and a reclined sleeping position. A top tube assembly is coupled to a portion of the convertible child seat and is positioned above the seat structure spaced from the seating surface. The top tube assembly moves in concert with the seat structure when the seat structure is repositioned between the inclined seating position and the reclined sleeping position.

20 Claims, 11 Drawing Sheets

CONVERTIBLE CHILD SEAT

RELATED APPLICATION DATA

This patent is related to and claims priority benefit of U.S. provisional application Ser. No. 62/009,913 filed Jun. 10, 2014 and entitled "Convertible Child Seat." The entire contents of this prior filed provisional application is hereby incorporated herein by reference.

BACKGROUND

1. Field of the Disclosure

The present disclosure is generally directed to child seating and sleeping devices, and more particularly to a device that can be converted from an infant sleeping bassinet to an infant or child seat.

2. Description of Related Art

Infant sleeping devices are known in the art and are provided in a number of different forms. One form is a bassinet that has a generally flat and substantially horizontal sleeping surface and a side wall surrounding the sleeping surface. Infant seats are also known in the art, such as in the form of an infant carrier, a swing, a rocker, or a bouncer seat. These types of seats typically have a non-flat seating surface with a seat bight region between a seat back and a seat bottom. Infants are not yet able to sit upright or hold their head up or steady. Thus, the seat bottom is typically not horizontal but tilted at least slightly up and toward the seat bight region. Also, the seat back is typically not vertically upright or horizontally flat, but instead is reclined rearward to a degree so that the infant is still fully supported by the seating surface in a comfortable and safe seated position. Products that combine the features of a bassinet and an infant seat are not particularly well known.

TINY LOVE™ has offered a convertible seating device known as a 3-in-1 Rocker Napper. The Tiny Love product has a bassinet mode and a seat mode and is also a rocker mode. The seating/sleeping surface is formed from plastic and has a seat bottom and a seat back. The seat back incline angle can be adjusted among a flat condition, an intermediate orientation, and a reclined seat orientation. A fabric side wall is formed using two fabric sections, a head section and a foot section. Each is supported by a separate, independent tube. At least one of the tubes is independently pivotable about a pivot point along each side of the seat relative to the other tube. To switch the seat between the bassinet and seat configuration, the top tube or tubes must be separately moved to separately deploy or drop the side walls or curtains surrounding the seating surface independent of adjusting the position of the seating surface.

Fisher Price has offered a seating device known as the Rock and Play, which uses a sling style seat. The seat can be adjusted between a nearly flat sleeping position and an inclined seating position. A webbing strap is used to incline the sling seat. There is no bassinet style side wall or curtain surrounding the seating surface in the sleeping position. The seat thus does not resemble a bassinet in the sleeping mode, but the seat is still marketed as a sleeping device due to the extreme, nearly flat reclined position. Others have offered seating devices that are similar to this Fisher-Price product as well.

SUMMARY

In one example according to the teachings of the present disclosure, a convertible child seat has a frame assembly and a seat structure supported by the frame assembly. The seat structure defines a seating surface and is movable between at least an inclined seating position and a reclined sleeping position. A top tube assembly is coupled to a portion of the convertible child seat and is positioned above the seat structure spaced from the seating surface. The top tube assembly moves in concert with the seat structure when the seat structure is repositioned between the inclined seating position and the reclined sleeping position.

In one example, the convertible child seat includes a side wall or side curtain that extends between the top tube assembly and the seat structure.

In one example, the top tube assembly can be automatically repositioned between a bassinet height and a sitting height relative to the seating surface when the seat structure is repositioned between the reclined sleeping position and the inclined seating position, respectively.

In one example, the convertible child seat has a side wall or side curtain that extends between the top tube assembly and the seat structure. The side wall or side curtain can be reconfigured in concert with the top tube assembly when the seat structure is repositioned.

In one example, the convertible child seat has a side wall that can be a fabric curtain suspended between the top tube assembly and the seat structure.

In one example, the seat structure can be repositioned using only one hand.

In one example, the convertible child seat has a side wall or side curtain extending between the top tube assembly and the seat structure. The seat structure, side wall or side curtain, and top tube assembly can move in concert with one another when the seat structure is repositioned with only one hand.

In one example, the seat structure and top tube assembly can be repositioned with only one hand, which can manipulate a release mechanism on the seat structure.

In one example, movement of a seat back portion of the seat structure automatically can move a seat bottom portion of the seat structure when the seat structure is repositioned.

In one example, movement of a seat back portion of the seat structure can automatically also move or reposition the top tube assembly.

In one example, a distance between a seat back portion of the seat structure and a corresponding head part of the top tube assembly can be greater in the reclined sleeping position and lesser in the inclined seating position.

In one example, a distance between a seat bottom portion of the seat structure and a corresponding foot part of the top tube assembly can be greater in the reclined sleeping position and lesser in the inclined seating position.

In one example, the frame assembly can have a curved rocker base on which the convertible child seat rests.

In one example, the convertible child seat can also have a linkage coupled to a seat back portion and a seat bottom portion of the seat structure.

In one example, a seat back portion and a seat bottom portion of the seat structure can be pivotally connected to one another at a seat pivot joint and the seat back portion can be pivotally connected to the frame assembly at a seat back pivot joint different from the seat pivot joint.

In one example, repositioning the seat structure can automatically change the orientation of the top tube assembly.

In one example, the seat structure can have a seat back portion that can have an angle of about 10 degrees relative to a horizontal reference with the seat structure in the reclined sleeping position and that can have an angle of about 50 degrees relative to the horizontal reference with the seat structure in the inclined seating position.

In one example, a seat back portion and a seat bottom portion can be generally parallel to one another in the reclined sleeping position.

In one example, the seat structure can have a seat back portion oriented at an angle of about 10 degrees relative to a horizontal reference with the seat structure in the reclined sleeping position and oriented at an angle of about 50 degrees relative to the horizontal reference with the seat structure in the inclined seating position. A distance between the seat back portion and a corresponding head part of the top tube assembly can be greater in the reclined sleeping position and lesser in the inclined seating position.

In one example, the seat structure and frame assembly can be removably coupled to a frame structure of a child seating device. The child seating device can be a child swing or a glider.

In one example, the top tube assembly can include a head part coinciding with a seat back portion of the seat structure and can include a foot part coinciding with a seat bottom portion of the seat structure. The head part and foot part can be fixed to one another so that the head and foot parts do not move relative to one another as the top tube assembly moves relative to the seat structure when the seat structure is repositioned.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The disclosed convertible child seat (hereinafter a child seat or seat) solves or improves upon one or more of the above-noted and/or other problems and disadvantages with prior known child seats. The disclosed child allows for one-hand operation to convert the seat structure from a bassinet position to a seating position and vice versa. The disclosed child seat has a top tube assembly coupled to the seat structure that is automatically repositioned when the child seat is repositioned or converted. The top tube assembly of the disclosed child seat is automatically repositioned from a bassinet position to a seating position and vice versa when the child seat is converted or repositioned. These and other objects, features, and advantages of the disclosed convertible child seat will become apparent to those having ordinary skill in the art upon reading this disclosure.

Figure 1:
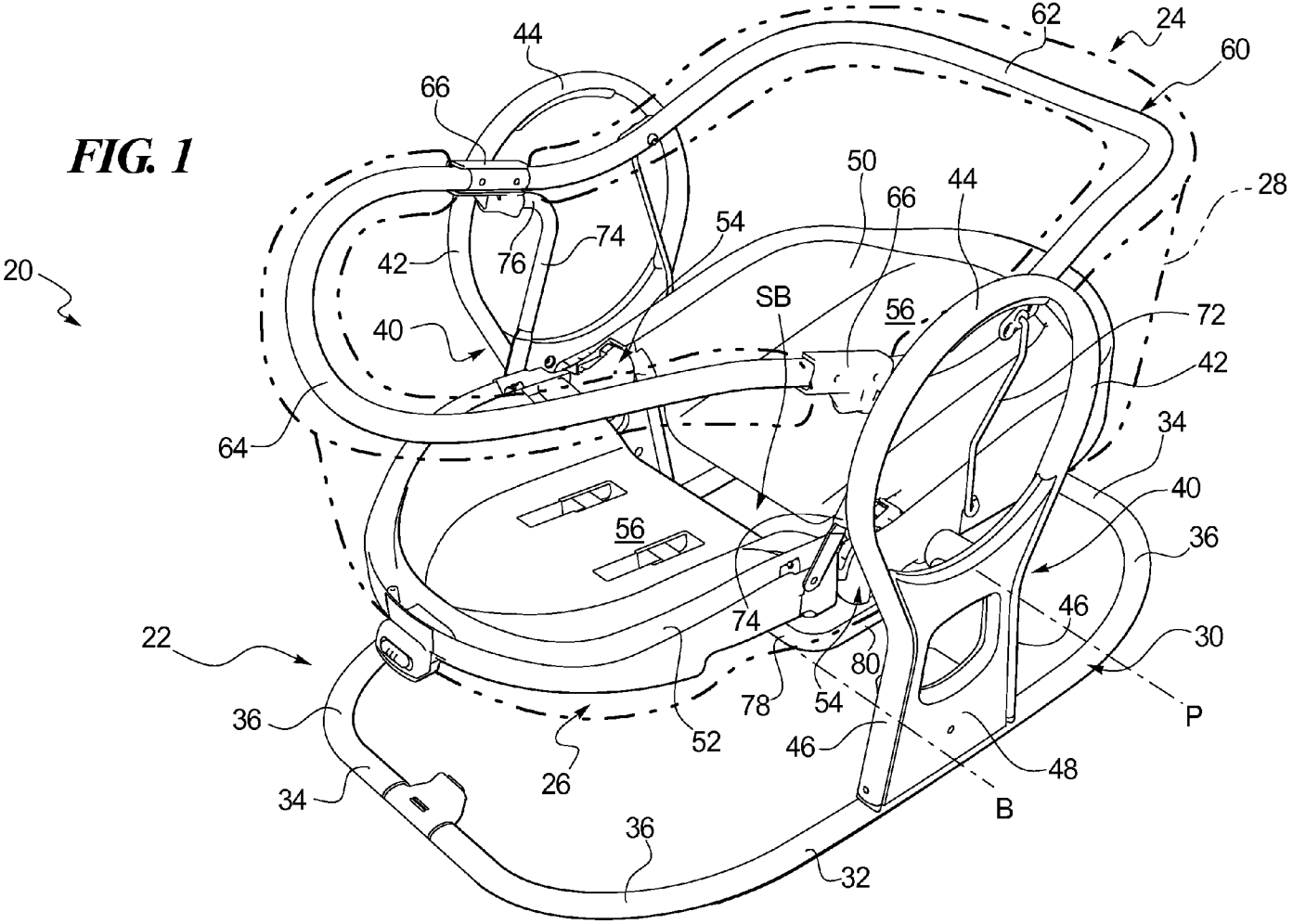
FIG. 1 shows a top perspective view of one example of a convertible child seat constructed in accordance with the teachings of the present disclosure, and in a reclined bassinet mode.
Figure 2:
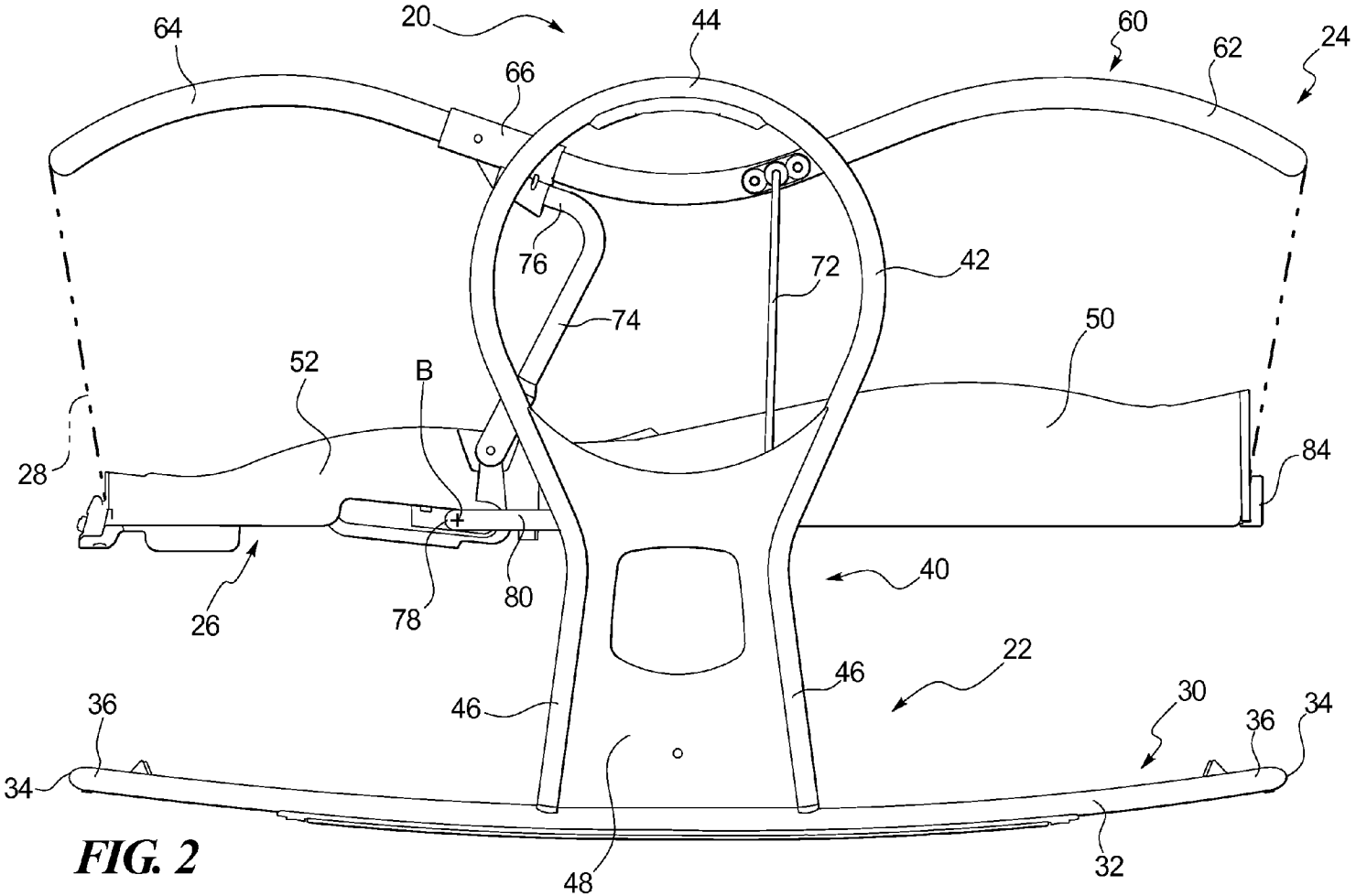
FIG. 2 shows a side view of the convertible child seat of FIG. 1, but with all soft goods removed.

Turning now to the drawings, FIGS. 1 and 2 show one example of a convertible child seat 20 constructed in accordance with the teachings of the present disclosure. The disclosed convertible child seat 20 is configured to be repositionable between a reclined bassinet mode, as shown in FIGS. 1 and 2, and an inclined seating mode, as described below. The child seat 20 has a frame assembly 22 supporting a seat assembly 24 above a surface. The frame assembly 22 in the disclosed example has a number of components that are described below. The seat assembly 24 has a seat structure 26 and soft goods that would cover and surround portions of the seat structure in the completed child seat 20. In this example, the soft goods might include padding and fabric (not shown) that covers appropriate shell parts of the seat structure 26 and a side wall or side curtain 28 (shown only in phantom in FIG. 1) that surrounds portions of the seat structure. FIG. 2 shows the child seat 20 of FIG. 1 without any of the soft goods. The configuration and construction of both the frame assembly 22 and seat assembly 24 can vary from the examples shown and described herein. The examples are disclosed herein to show and teach various features and aspects of the child seat 20.

Various features, components, aspects, and combinations thereof for the seat structure 26 and the child seat 20 are disclosed herein. However, the disclosure is not intended to limit the scope of the invention or claims to only those combinations of the disclosed specific features, components, and aspects. Each may be capable of standing alone. Each may be combined with any one or more of the other features, aspects, and components and yet fall within the spirit and scope of the present disclosure.

The frame assembly 22 generally has a base 30 that is configured to rest on a surface. The base in this example is a generally rectangular ring shape with elongate sides 32 and shorter ends 34. The sides 32 and ends 34 are joined at rounded corners 36 in this example. However, the construction of the base 20 can vary and can instead have two or more separate sections that each can rest on a surface. However, the base 30 in this example is optionally curved in a lengthwise direction, i.e., the sides 32 are upwardly curved or bent, as shown in FIG. 2. The curved base 30 allows the child seat 20 to rock when resting on the surface. Thus, the convertible child seat 20 can provide a rocker function, if desired, to assist in soothing an occupant of the child seat. The base 30 could instead be flat on the bottom to prevent any rocking motion, or could instead be curved side-to-side (i.e., the ends 34 could be upwardly curved or bent) to change the rocking direction of the child seat 20.

The disclosed frame assembly 22 also has a pair of side supports 40 that are arranged opposing one another across and on each side of the seat assembly 24. The side supports 40 extend up from the sides 32 of the base 30 and are coupled to and support the seat assembly 24 above the base 30. In this example, each side support 40 has a keyhole like shape with a circular tube or segment 42 at the upper end of the support. The exposed top ends of the segments 42 can define handles 44 to lift and carry the child seat 20. Each side support 40 also has one or more legs 46 that continue down from the circle like segment 42, as shown in FIGS. 1 and 2. The leg or legs 46 are coupled to the base 30. In this example, with two of the legs 46, a bracing structure 48 is positioned between the legs to impart rigidity and strength to the frame assembly 22 and, specifically, the side supports 40.

The configuration and construction of the side supports 40 can be varied substantially from the design shown and yet fall within the scope of the disclosure. The side supports 40 should be capable of supporting the seat assembly 24 above the base 30 and the surface in a manner that is stable and safe for the child occupant of the child seat 20. The side supports 40 can be part plastic, part resilient composite, and/or part metal such as aluminum, steel, or the like. The components of the frame assembly are not intended to be limited to any particular materials for their construction. The frame assembly 22 might also be optionally capable of allowing or imparting a bouncer seat function. This can be provided in part by the configuration and in part by the material selection for one or more of the components of the base 30, side supports 40, and/or frame assembly 22.

Figure 3:
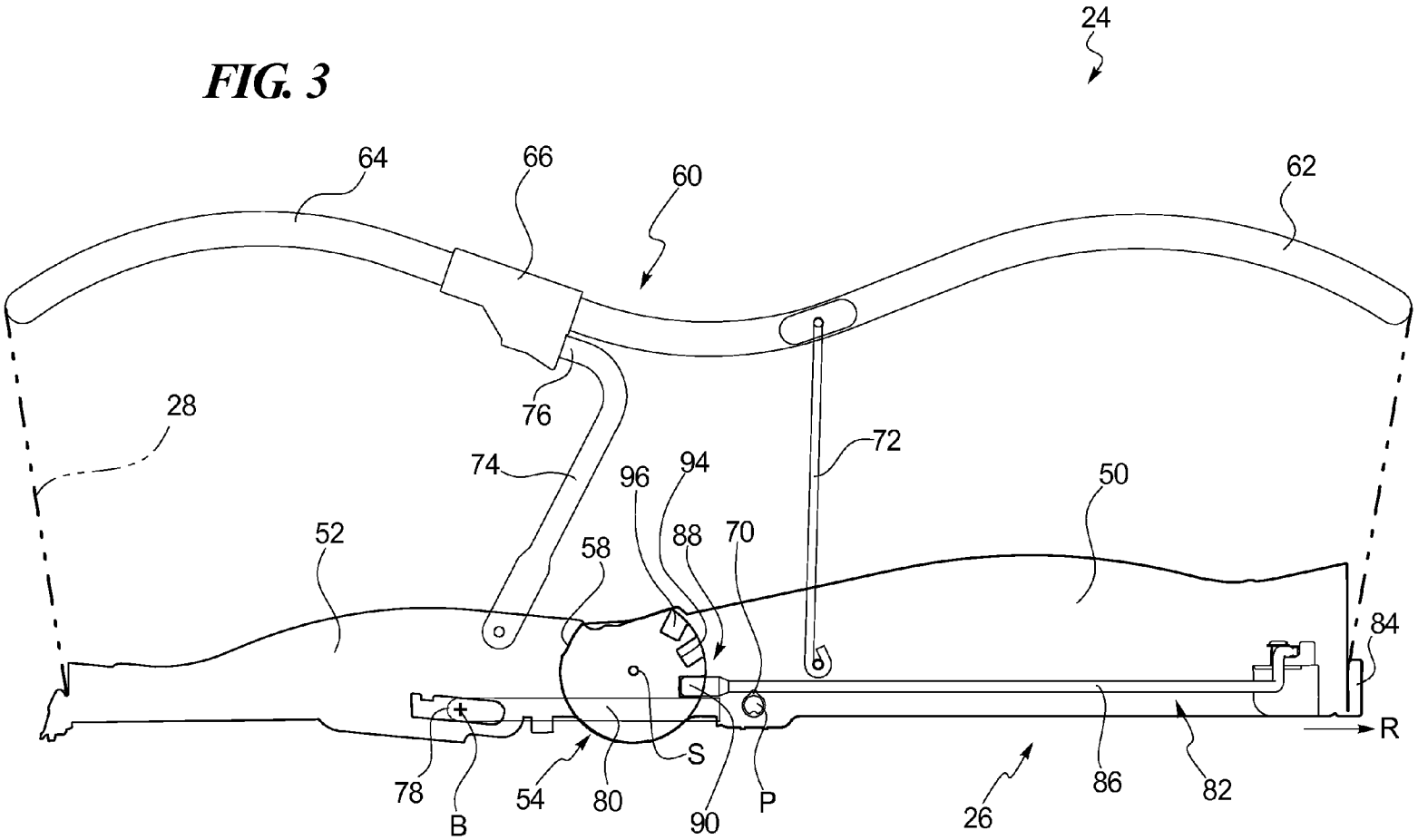
FIG. 3 shows a seat structure of the convertible child seat of FIGS. 1 and 2 in a reclined bassinet position and partially cut away to reveal a release mechanism.

The seat structure 26 of the seat assembly 24 is depicted in FIG. 3 to illustrate its basic general components. In FIG. 3, like FIGS. 1 and 2, the seat structure 26 and thus the seat assembly 24 is shown in the reclined bassinet or sleeping position. The seat structure 26 has a seat back portion 50 and a seat bottom portion 52 that are pivotally connected to one another along a seat bight region SB at a seat pivot joint 54. Each of the seat back and seat bottom portions 50, 52 has an upward facing surface that together define a seating surface 56 of the seat structure 26. In the reclined bassinet or sleep position, the seat back portion 50 and seat bottom portion 52 can be generally aligned with one another to create a substantially flat seating surface 56. Alternatively, the seat back and bottom portions 50, 52 may be arranged at a slightly non-parallel angle of less than 180 degrees, if desired, so that the seating surface 56 is no completely flat. In one example, the seating surface 56 can be generally parallel to a horizontal reference when in the reclined sleeping position of FIGS. 1-3. In another example, the seating surface 56 can be at about a 10 degree angle relative to the horizontal reference, with the seat back portion 50 elevated above the seat bottom portion 52. The slight incline angle may be necessary or mandated by government and/or product design regulations and standards, such as if the seat assembly 24 were provided with a safety harness to secure an infant in the child seat 20.

Each of the seat back portion 50 and seat bottom portion 52 can be a plastic molded shell and each can be a stand-alone, one-piece component connected to the other. For example, in this example, the seat pivot joint 54 is created at pivot hubs 58 at each side of the seat structure 26. Though not shown in detail herein, each of the seat back and seat bottom portions 50, 52 can carry an integrated, molded hub section on each side of the seat structure. The hub sections on each side of the seat structure can pivotally join with one another in order to define a seat pivot axis S on each side of the seat structure and to form the pivot hubs 58 and seat pivot joints 54. Alternatively, either or both of the seat back and seat bottom portions 50, 52 can instead be formed of other materials and/or can be assembled from multiple parts, if desired.

With reference to FIGS. 1-3, the disclosed seat assembly 24 or seat structure 26 also has a top bar or top tube assembly 60 that can be configured to support the side wall or side curtain 28 on the seat structure 26. The top tube assembly 60 is configured and arranged to move in concert with the seat structure 26 as the seat structure is repositioned, as described below. In this example, the top tube assembly 60 has a head part 62 that coincides positionally with the seat back portion 50 and a foot part 64 that coincides positionally with the seat bottom portion 52. In this example, the top tube assembly 60 is spaced from the seating surface 56 and surrounds the seat structure 26. As depicted in FIG. 1, the side wall or side curtain 28 extends between the top tube assembly 60 and the seat structure 26, creating a visual, vertical barrier around the seating surface 56, similar to a bassinet side wall. The top tube assembly 60 in this example is formed of two tube parts, the head part 62 and the foot part 64, that are fixed to one another via connectors 66. However, the two parts 62, 64 of the top tube assembly 60 do not move relative to one another in this example. Thus, the top tube assembly can be formed as a single piece, if desired.

Figure 4:
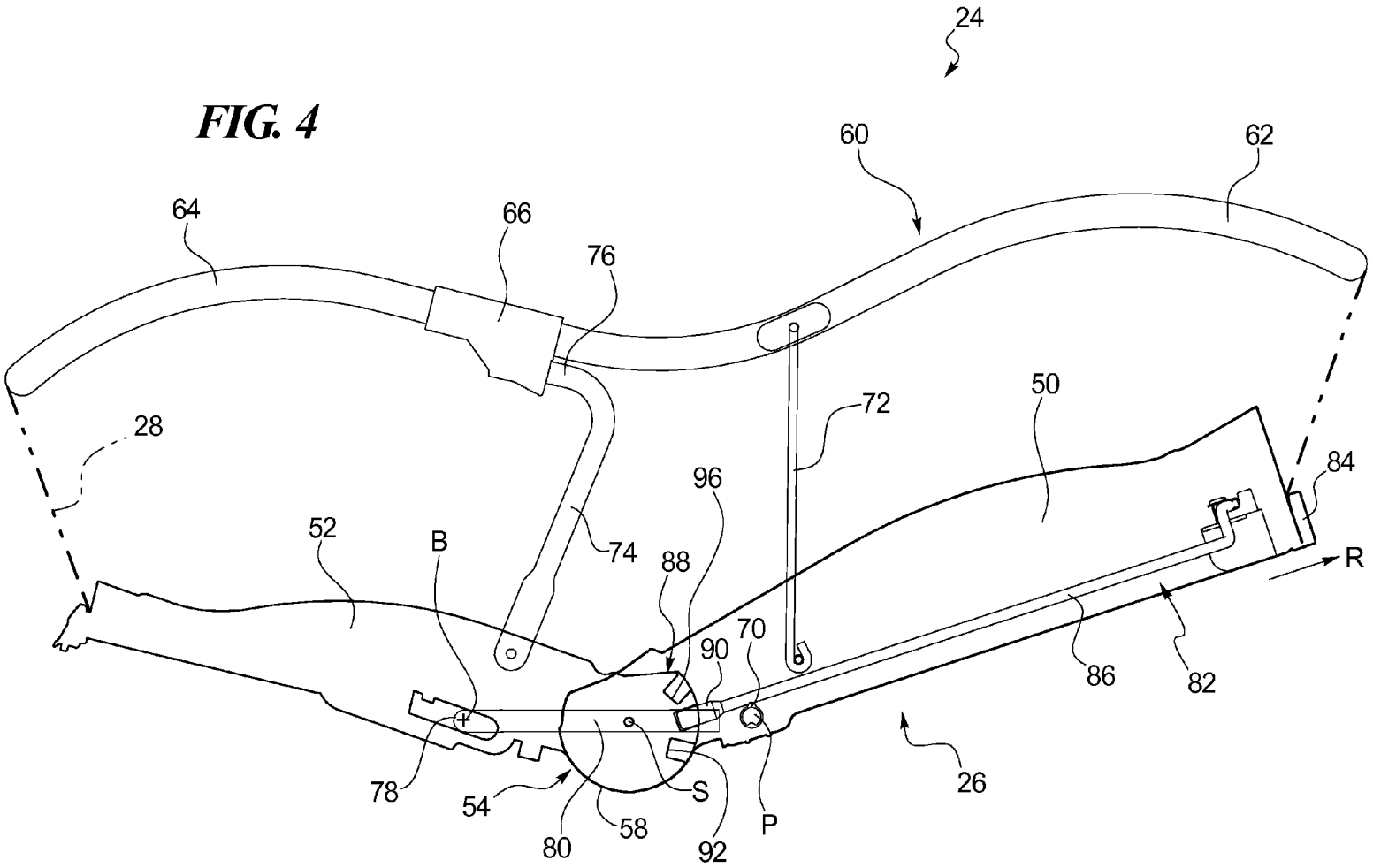
FIG. 4 shows the seat structure of FIG. 3, but with the seat structure in an intermediate seating position.
Figure 5:
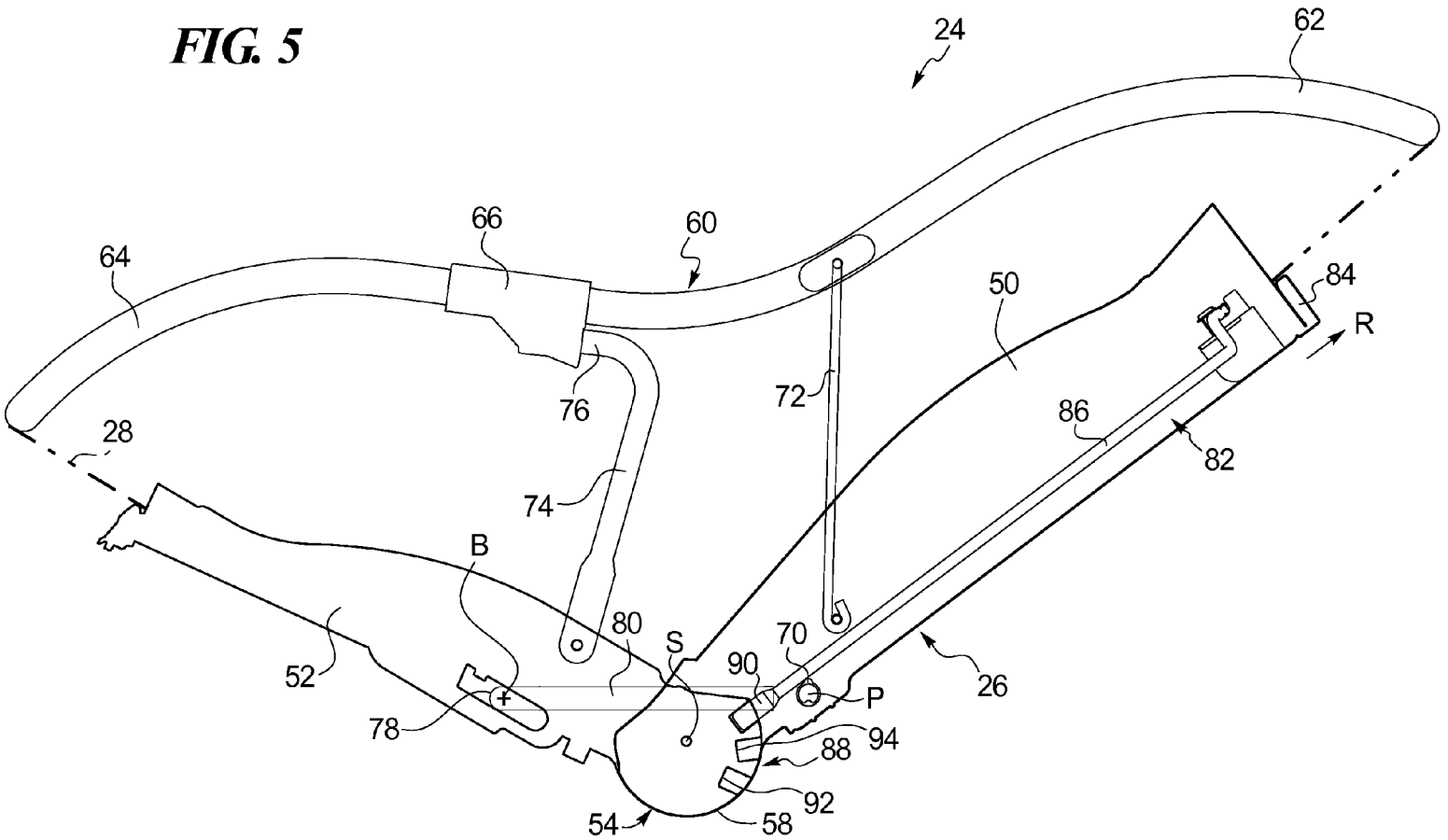
FIG. 5 shows the seat structure of FIG. 3, but with the seat structure in an inclined seating position.

The seat structure 26 can be reconfigured between two or more different selectable positions, as depicted in FIGS. 3-5. The seat structure 26 in this example can be repositioned from the above-described reclined bassinet or sleeping position as shown in FIGS. 1-3 to an optional intermediate sitting position as shown in FIG. 4 and to an inclined seating position as shown in FIG. 5. When the seat structure is repositioned, the seat back and seat bottom portions 50, 52 move in unison or in concert with one another. The upper end of the seat back portion 50 can be tilted up or inclined from the reclined bassinet or sleeping position to an elevated position above the seat bight region SB. Doing so also moves the seat bottom portion 52 from the reclined bassinet or sleeping position to a tilted up position where the front edge of the seat bottom portion is also elevated above the seat bight region SB, as shown in FIGS. 4 and 5. As the seat back and seat bottom portions 50, 52 move, the top tube assembly 60 also moves automatically as a single unit from a generally level orientation in the reclined bassinet or sleeping position of FIGS. 1-3 to a tilted orientation in the inclined seating position of FIG. 4 or 5. How this occurs is described in more detail below. The side wall or side curtain 28 will thus also move.

In the reclined bassinet or sleeping position, the side wall or side curtain 28 is at a relatively greater distance from the seat structure to create the visual sleeping barrier surrounding the seating surface 56. In the inclined seating position, the top end of the seat back portion 50 and front edge of the seat bottom portion 52 are elevated closer to the respective head and foot parts 62, 64 of the top tube assembly 60. This results in the side wall or side curtain 28 being relatively shorter in the inclined seating position, reducing the visual barrier so that an infant seat occupant can see out from the seat.

Figure 6:
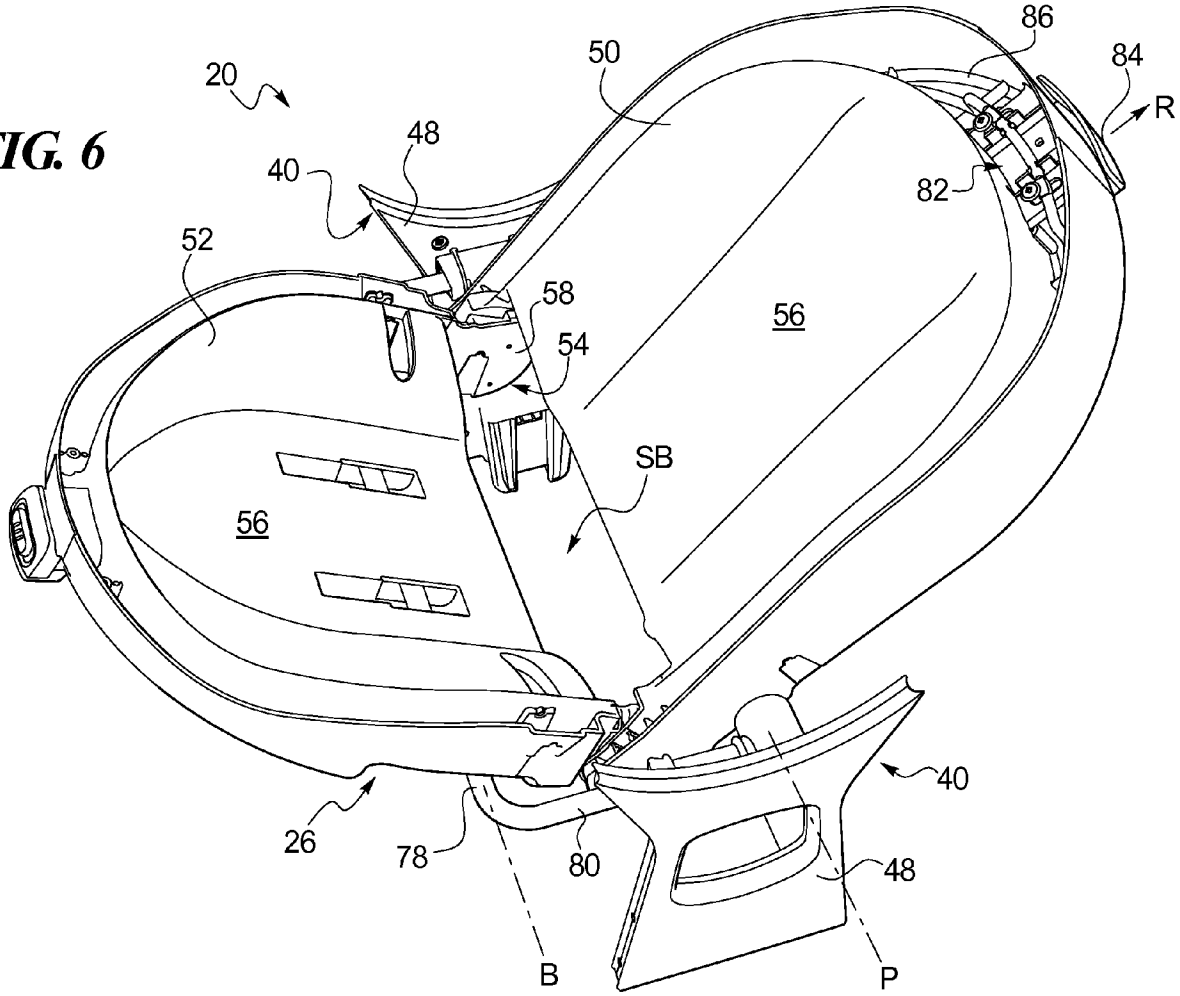
FIG. 6 shows a top perspective view of the convertible child seat of FIG. 1, but in an inclined seating mode with the seat structure in the inclined seating position of FIG. 5 and partially cut away to reveal the release mechanism.
Figure 7:
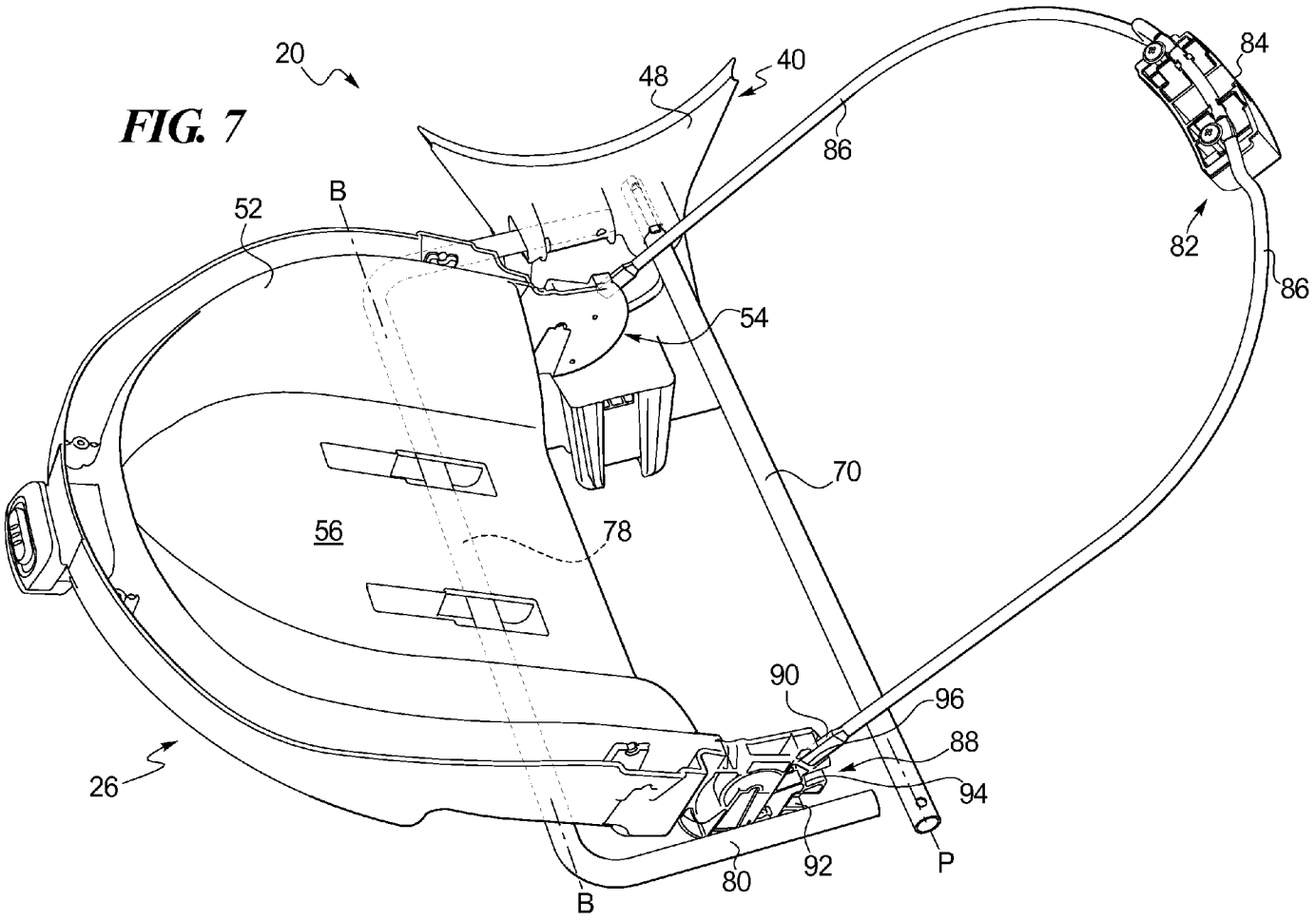
FIG. 7 shows the seat structure of FIG. 6, but with a seat back portion removed depicting the components of the release mechanism of the convertible child seat.

With reference to FIGS. 5-7, a linkage system interconnects components of the child seat 20. The linkage system includes a first bar 70 that extends transversely across the frame assembly 22. The two free ends of the first bar 70 are connected to the side supports 40 at fixed locations. The first bar also extends through parts of the seat back portion 50 so as to connect the seat back portion to the frame assembly 22. The first bar 70 defines a seat back pivot axis P about which the seat back can pivot. The position of the seat back pivot axis P is fixed relative to the side supports 40 and frame assembly 22. A first vertical link or rod 72 is disposed on each side of the seat structure 26. Each first link 72 has an upper end that is pivotally connected to the head part 62 of the top tube assembly 60 and a lower end that is pivotally connected to a side of the seat back portion 50, rearward of the seat back pivot axis P on its respective side of the frame assembly 22.

The linkage system also has a second link or rod 74 disposed on each side of the seat structure 26. Each second link 74 has an upper end that is fixed to a portion of the top tube assembly 60. In this example, the upper end of each second link 74 has a forward extending segment 76 that is coupled to its respective connector 66 on the top tube assembly 60. Each second link 74 also has a lower end that is pivotally connected to a side of the seat bottom portion 52 on its respective side of the seat structure 26. The second links 74 are connected to the top tube assembly 60 forward of the first links 72 and connected to the seat bottom portion 52 forward of the seat pivot axis S.

The linkage system includes a second bar 78 that extends transversely across the frame assembly 22. Two free ends of the second bar 78 are bent to form rearward extending legs 80 that are connected to the side supports 40 at fixed locations, as depicted in FIGS. 6 and 7. The second bar 78 extends through one or more slots 82 provided on the underside of the seat bottom portion 52 in this example. The second bar 78 is positionally fixed and thus defines a fixed seat bottom pivot axis B as depicted in FIGS. 3-5 and 7. The seat bottom pivot axis B is positioned forward of the seat pivot axis S and slightly forward of the second link 74 including its connection to the seat bottom portion. The seat bottom portion 52 rests on and is supported by the second bar 78. However, the slots 82 render the connecting between the second bar 78 and the seat bottom portion 52 a loose connection allowing some play between the two components. In an alternative example, the slots could be eliminated and the seat bottom portion 52 could simply rest on and slide relative to the second bar 78. In another alternative example, the second bar 78 could be loosely connected to the seat bottom portion 52 using sloppy pivots or fasteners that allow some play between the two components while keeping them connected to one another.

With reference to FIGS. 3-8, the seat structure 26 in this example also has a release mechanism 82. The release mechanism 82 can be biased to a latched or engaged position that retains the seat structure in a desired position. The release mechanism 82 can be actuated, overcoming the biasing force, to release, i.e., unlatch or disengage the release mechanism to allow the seat structure to be repositioned as described above and as shown in FIGS. 3-5. In one example, the release mechanism 82 has an actuator 84 positioned at a top end of the seat back portion 50. The actuator 84 can alternatively be positioned on the back side of the seat back portion, on the seat bottom portion 52, or near but not at the top end of the seat back portion. The release mechanism 82 also has two rods 86 that extend between the actuator 84 and each of the pivot hubs 58 at the seat pivot axis S. In this example, the rods 86 can be part of a unitary rod structure to which the actuator 84 is attached or can be two separate rods connected to the actuator.

Figure 8:
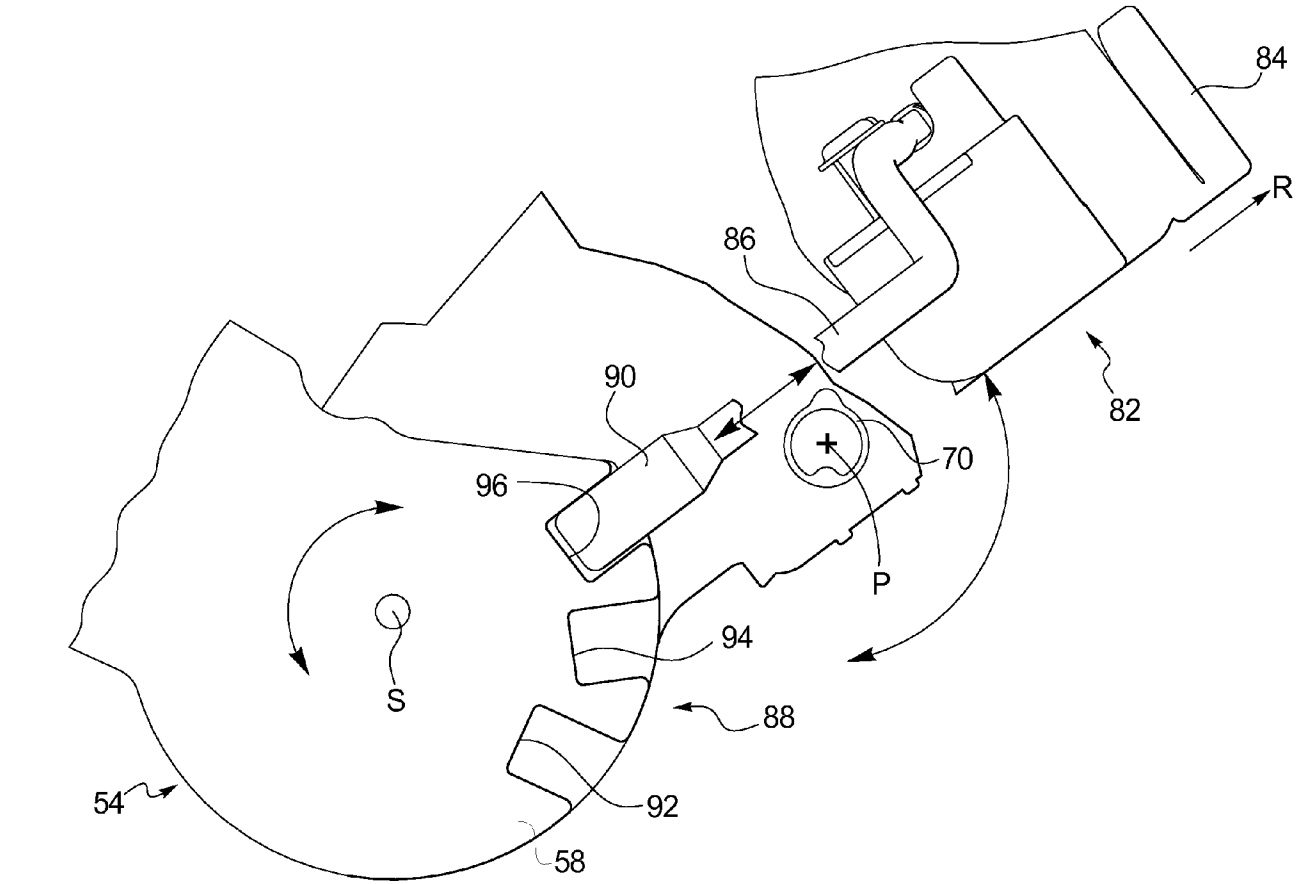
FIG. 8 shows a side view of the release mechanism shown in FIGS. 5-7 and in an engaged or latched position retaining the seat structure in the inclined seating position.

The release mechanism 82 in this example also has a latch 88 that is provided within each of the pivot hubs 58 at the seat pivot axis S, as best illustrated in FIGS. 7 and 8. Each latch 88 is comprised of a free end or latching end 90 on the respective rod 86 and two or more separate latch receivers or pockets configured to receive the respective latching end. In this example, each pivot hub 58 is configured to define three such latch receivers or pockets including a reclined position pocket 92, an inclined position pocket 94, and an intermediate position pocket 96. The reclined position pocket 92 coincides with the reclined sleeping or bassinet position of the seat structure 26 depicted in FIG. 3. The intermediate position pocket 94 coincides with the intermediate position of the seat structure 26 depicted in FIG. 4. The inclined position pocket 96 coincides with the inclined seating position of the seat structure 26 depicted in FIG. 5.

In other examples, the latches 88 can includes mating gear teeth, a dog and pawl arrangement, a detent arrangement, or other such latching components. The actuator 84 can be used to move the rod or rods 86, which in turn can disengage or release the latching ends 90 from the latch receivers or pockets 92, 94, 96, allowing the seat structure position to be adjusted. One or more springs or other biasing elements or devices can be utilized to bias the rod or rods 86 and the actuator 84 to the engaged or latched position, which in turn can lock or retain the seat structure 26 in a selected position. These types of release mechanisms are known in the art for other child seat products and for adjusting the incline/recline angle of the seat back on such products. The configuration and construction of the release mechanism 82 can vary without departing from the scope of the disclosure and claims.

The seat back portion 50 and seat bottom portion 52 are pivotally connected to one another about the seat pivot axis S defined within the pivot hubs 58 along the seat bight region SB. The seat back portion 50 is also pivotally attached to the side supports at the fixed seat back pivot axis P defined by the first bar 70. When a user wishes to change the position of the seat assembly 24 relative to the frame assembly 22, the user can pull the actuator 84 in the direction of the arrow R shown in FIG. 8. This moves the rods 86 and releases the latches 88 by disengaging the latching ends 90 from the pockets 92, 94, or 96. The seat back portion 50 is then free to move or pivot, at least between the lowered or reclined bassinet position (FIG. 3) and the raised or inclined seating position (FIG. 5).

From the bassinet position to the seating position the user will lift, with the one hand that released the actuator, the top end of the seat back portion 50. In doing so, the seat back portion 50 will pivot about the fixed seat back pivot P. The top end of the seat back portion 50 will rise and the lower end at the seat bight region SB will fall. Thus, the seat pivot axis S will drop below the seat back pivot axis P as shown in FIG. 5. This movement of the seat back portion 50 automatically drops the back edge of the seat bottom portion 52 in concert therewith. The front edge of the seat bottom portion 52 will rise automatically, as the seat bottom rests on and pivots about the second bar 78 and seat bottom pivot axis B.

The second link 74 will automatically drop slightly along with the rear edge of the seat bottom portion 52 because of the location of the pivot connection of the second link to the seat bottom portion being rearward of the axis B. This movement of the second link 74 thus automatically pulls the foot end 64 of the top tube assembly 60 downward (compare FIGS. 3-5). The first link 72 will automatically rise as the top end of the seat back portion 52 rises. This is because of the location of the pivot connection of the first link 72 to the seat back portion being rearward of the seat back pivot axis P. The upward movement of the first link 72 will raise the head end 62 of the top tube assembly 60. Thus, raising the seat back portion to the seating position of FIG. 5 automatically tilts the top tube assembly 60 to the seating position. The movement of the seat back and bottom portions 50, 52 thus automatically brings the top end of the seat back portion 50 and the front edge of the seat bottom portion 52 closer to the top tube assembly, as shown in FIG. 5. This will thus automatically reduce the relative height of the side wall or side curtain 28 from the bassinet mode height to the lesser seat mode height.

When the seat back portion reaches the desired position, such as the inclined seating position as depicted in FIGS. 5-8, the spring(s) or biasing element(s) may fire the latching ends 90 of the rods into the corresponding latch receivers or pockets, such as the inclined position pockets 96. To return the child seat 20 to the bassinet mode, the user again can release the release mechanism 82 via the actuator 84 on the seat back portion 52. The user can then lower the top end of the seat back portion 52, which in turn will raise the seat pivot axis S. In doing so, the seat structure 26 will return to the intermediate position of FIG. 4 or the bassinet position of FIG. 3. The tope tube assembly 60 will automatically return to the level orientation or bassinet mode, which places the side wall or side curtain 28 in the bassinet position surrounding the seating surface 56 as shown in FIGS. 1-3. All of the aforementioned movements can be done with the one hand that actuates the actuator 84 and in one continuous movement once actuated.

The disclosed linkage system can include one or more components that may be considered part of the frame assembly, part of the seat assembly, part of the seat structure, and/or a stand-alone component distinct from these named sub-assemblies. The linkage system or any of its components need not be considered a part of any of these sub-assemblies.

The disclosed convertible child seat 20 provides one seat that can be converted from a bassinet configuration or mode to an inclined seat configuration or mode. A bassinet has always been a great sleeping solution for young infants. An inclined seat can be used for short naps, but is also used for entertaining a child (such as for swinging, rocking, bouncing, etc.) and allows the child to see and engage with their surroundings. The disclosed child seat 20 easily converts from one position to the other without having to secondarily readjust the side wall or side curtain, or any other part of the seat. Also, the user can convert the child seat one-handed and with one easy fluid motion.

When the seat back portion is inclined, the seat bottom portion also inclines to give a traditional infant seat shape, such as that provided by a traditional infant carrier, bouncer seat, or swing. The disclosed design differs from prior art seats in that the top tube or top bar assembly operates automatically and as a single unit. The top tube assembly can be a rigid top tube that tilts forward as a complete entity as the seat back portion is inclined to the seat position or mode. The result is a papasan-shaped seat, typical of many infant seats on the market. The disclosed seat can have a deep center that tapers to a more shallow head and foot area to support an infant seated in the child seat. The top tube assembly tilts forward using the disclosed linkage system, with linkage components on each side of the child seat. When the child seat is reclined to the bassinet mode or sleeping position, the child seat mimics a standard bassinet configuration, which helps convey to the consumer that it is indeed a sleeping solution.

When the child seat is inclined to the seat position, the wave-like top tube assembly can offer a more open feel around the child's head, feet, and hips, while providing the required side containment at the child's shoulders. The contouring of the top tube assembly can be altered to achieve the desired positioning in each mode and the desired effect in each position. Side containment requirements are dictated by U.S. federal regulations. The contoured shape of the top tube assembly is also unique in comparison to prior art seats of this type, which have a generally flat configuration when viewed from the side. The disclosed top tube assembly 60 has a curved contour that dips toward the seating surface 56 nearer the center (i.e., nearer the side supports 40 and the seat pivot axis S) and nearer the head end and foot end. The disclosed top tube assembly 60 also is contoured so as to protrude out and away from the seating surface nearer a shoulder location and a knee location of a seated infant (i.e., between the center and the head end and between the center and the foot end).

With the disclosed convertible child seat, the seat back and seat bottom portions adjust relative to each other to provide the desired seat angle along the seating surface. The disclosed child seat employs a single top tube assembly to form the bassinet top and to define the side wall or side curtain, which then tilts forward as the seat is inclined. The linkage system is unique in how it connects the top tube assembly to the seat bottom portion and seat back portion. There are many alternative ways in which this can be accomplished. Some ways would achieve the same result, while others might position the top tube assembly and seat structure components in slightly different positions. The contouring of the top tube assembly could be used to counteract such differences, if desired.

The disclosed side wall or side curtain 28 can be a fabric material that loosely hands from the top tube assembly 60. The side wall or side curtain, however, can be formed of other materials and be configured so as to be fixed to one or both of the top tube assembly and the seat structure. The side wall or side curtain can also be formed of multiple pieces that together define the entire wall or can be one contiguous piece. The material can be opaque, translucent, mesh, and/or the like.

Figure 9:
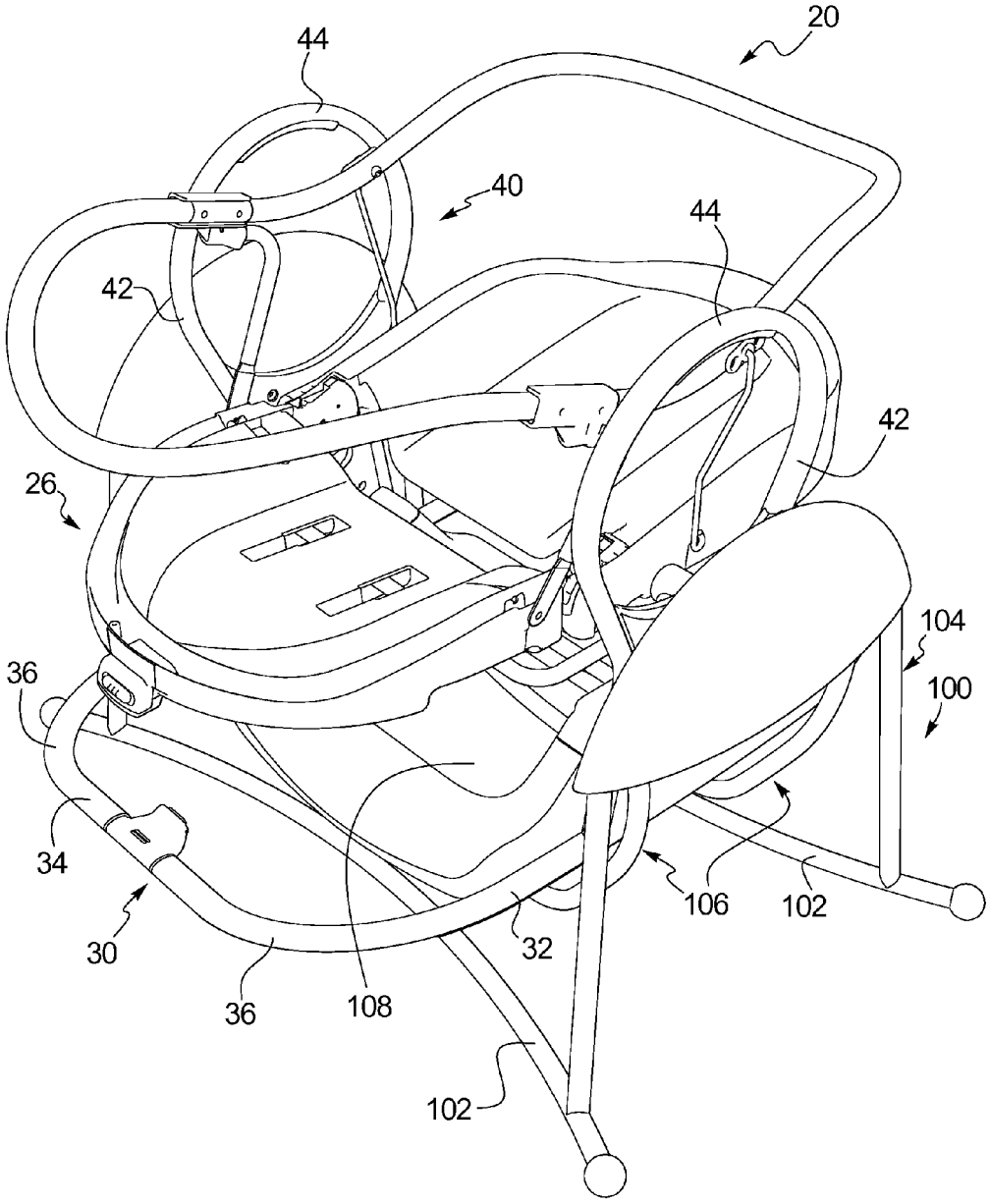
FIG. 9 shows the convertible child seat of FIG. 1 but removably mounted on a frame of a separate child seating device in the form of a child swing.

FIG. 9 illustrates that the entire convertible child seat, such as the child seat 20, can be configured to be removably mounted to the frame of another child seating device. In this example, a swing frame 100 is configured having a base 102 and side supports 104. The swing frame 100 also has a swinging carriage 106 coupled to a mount 108 suspended from the side supports 104. The mount 108 of the swinging carriage 106 can be configured to accept the frame 22 of the child seat 20 in a removable manner. In this way, the child seat 20 can be converted to a child swing that utilizes the convertible seat or to an infant rocker when removed from the swing frame 100.

Figure 10:
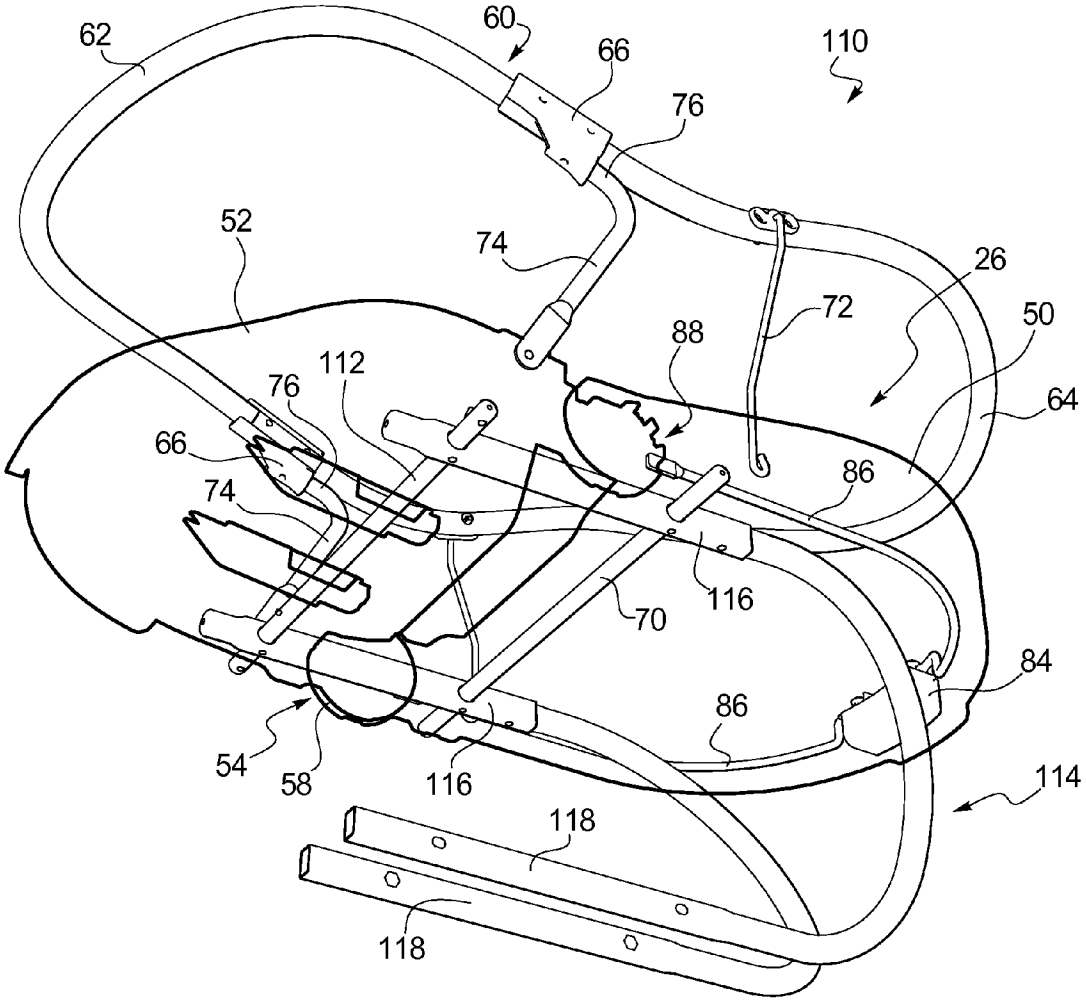
FIG. 10 shows an underside perspective view of another example of a convertible child seat constructed in accordance with the teachings of the present disclosure.

FIG. 10 shows an alternative example of a convertible child seat 110 constructed in accordance with the teachings of the present disclosure. In this example, like reference number are intended to represent like parts in comparison to the child seat 20 as described above. The seat structure 26 is also intended to operate in exactly the same manner. In this example, the frame assembly 22 and side supports 40 are removed and the second bar 78 is replaced by a linear second bar 112 coupled to the seat bottom portion 52. In this example, a pair of U-shaped frame elements 114 are positioned under the seat structure 26. The U-shaped frame elements each have an upper leg 116 attached to both of the first and second bars 70 and 112. The U-shaped frame elements 114 also each have a lower leg 118 that extends back under the seat structure 26.

Figure 11:
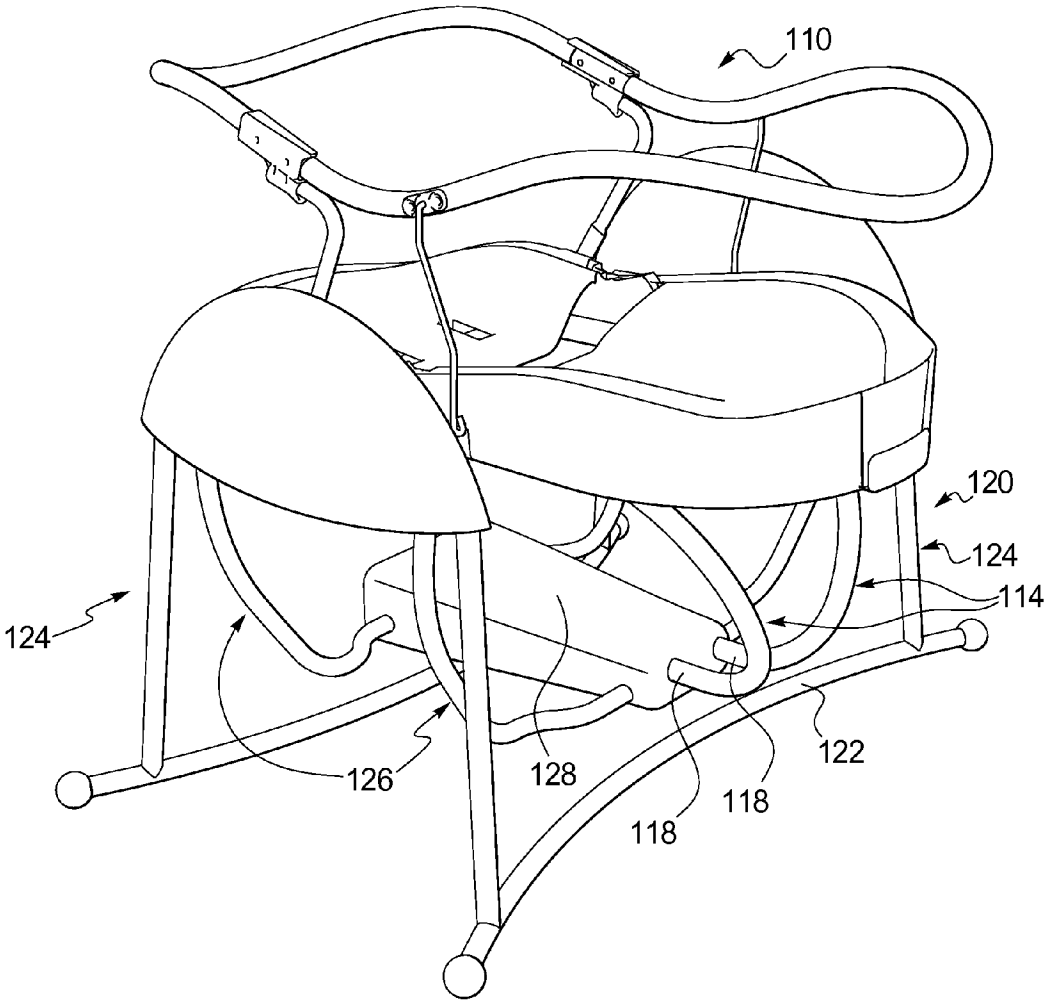
FIG. 11 shows a perspective view the convertible child seat of FIG. 10 and installed on a frame of a child seating device in the form of a glider.

FIG. 11 shows the convertible child seat 110 attached to a glider frame 120. The glider frame 120 has a base 122 and side supports 124. The glider frame 120 also has a glider carriage 126 suspended from the side supports 124. The glider carriage 126 has a mounting body 128 positioned between the side supports 124. In this example, the lower legs 118 of the U-shaped frame elements 114 are connected to the mounting body 128. In one example, the lower legs 118 can slide into tunnels or bores along the mounting body 128 to attach the child seat 110 to the glider frame 120. The lower legs can be configured to be removably attached using VALCO ball connections or other types of fasteners. The child seat 110 can instead be configured to be non-removable by the user. If removable, the U-shaped frame elements could be configured differently so as to provide a resting base on which the child seat can rest and be used separate from the glider frame 120. The U-shaped frame elements 114 can also be configured to provide a rocking function, a bouncy seat function or both, if desired.

The handles 44 provided on the child seat 20 or something similar can be provided on the child seat 110 or other seat designs. Such handles can make it easier for a user to manipulate and carry the child seat. The disclosed child seats can use two linkages on each side which can replace the slot and second bar, if desired. Likewise, the first bar can be removed and the seat structure can be mounted separately and pivotally to each side support. The disclosed convertible child seats can offer a look that is consistent with standard bassinets. Also, the disclosed child seats have the potential to create an extended seat back portion for more toddler use, if desired.

The disclosed top tube assembly is a one-piece structure, whether constructed of one or more than one part. The top tube assembly does not need separate action to move any part of the assembly. The disclosed top tube assembly can also be shaped so that it is wider at the top and bottom to give a more "open" feel while narrower at the shoulders to meet Federal regulations and to convey a snug seat.

The angle adjustments between the lying "flat" or sleeping position and the "seated" or seat position can vary from about 10 degrees up to about 50 degrees. This angle should not be any less than 10 degrees if the seat is to include a safety harness, per Federal regulation. The convertible child seat can also have one or more intermediate seat angles, such as about 30 degrees.

The disclosed convertible child seats can also be easily operated. The seats can be adjusted using only one hand. The one hand motion can adjust the seat incline angle as well as the top bar position and side wall height all at the same time with the same motion.

Although certain convertible child seats and features, aspects, and components thereof have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A convertible child seat comprising:

a frame assembly;

a seat structure supported by the frame assembly, the seat structure comprising a seat back portion and a seat bottom portion defining a seating surface and the seat back portion and the seat bottom portion are movable relative to each other between at least an inclined seating position and a reclined sleeping position;

a top tube assembly coupled to the convertible child seat, positioned above the seat structure, and spaced from the seating surface; and at least one first vertical link and at least one second vertical link interconnecting the seat structure with the top tube assembly;

wherein the seat back portion, the seat bottom portion, the at least one first vertical link, the top tube assembly, and the at least one second vertical link form a five-bar linkage, and wherein the top tube assembly moves in concert with the seat structure when the seat structure is repositioned between the inclined seating position and the reclined sleeping position to reduce or increase a distance between the top tube assembly and the seat structure.

2. A convertible child seat according to claim 1, further comprising a side wall extending between the top tube assembly and the seat structure and surrounding the seating surface.

3. A convertible child seat according to claim 2, wherein the side wall moves in concert with the top tube assembly when the seat structure is repositioned.

4. A convertible child seat according to claim 2, wherein the side wall is a fabric curtain suspended between the top tube assembly and the seat structure.

5. A convertible child seat according to claim 1, wherein the seat structure can be repositioned using only one hand.

6. A convertible child seat according to claim 5, wherein the seat structure, side wall, and top tube assembly move in concert with one another when the seat structure is repositioned.

7. A convertible child seat according to claim 5, wherein the one hand manipulates a release mechanism on the seat structure.

8. A convertible child seat according to claim 1, wherein movement of the seat back portion of the seat structure automatically moves the seat bottom portion of the seat structure and the top tube assembly when the seat structure is repositioned.

9. A convertible child seat according to claim 1, wherein a distance between the seat back portion of the seat structure and a corresponding head part of the top tube assembly is greater in the reclined sleeping position and lesser in the inclined seating position.

10. A convertible child seat according to claim 1, wherein a distance between the seat bottom portion of the seat structure and a corresponding foot part of the top tube assembly is greater in the reclined sleeping position and lesser in the inclined seating position.

11. A convertible child seat according to claim 1, wherein the frame assembly has a curved rocker base on which the convertible child seat rests.

12. A convertible child seat according to claim 1, further comprising an additional linkage coupled to the seat back portion and the seat bottom portion of the seat structure.

13. A convertible child seat according to claim 1, wherein the seat back portion and the seat bottom portion are pivotally connected to one another at a seat pivot joint, and wherein the seat back portion is pivotally connected to the frame assembly at a seat back pivot joint different from the seat pivot joint.

14. A convertible child seat according to claim 1, wherein repositioning the seat structure automatically changes the orientation of the top tube assembly.

15. A convertible child seat according to claim 1, wherein the seat back portion has an angle of about 10 degrees relative to a horizontal reference with the seat structure in the reclined sleeping position and has an angle of about 50 degrees relative to the horizontal reference with the seat structure in the inclined seating position.

16. A convertible child seat according to claim 14, wherein a distance between the seat back portion of the seat structure and a corresponding head part of the top tube assembly is greater in the reclined sleeping position and lesser in the inclined seating position, and wherein a distance between the seat bottom portion of the seat structure and a corresponding foot part of the top tube assembly is greater in the reclined sleeping position and lesser in the inclined seating position.

17. A convertible child seat according to claim 1, wherein the top tube assembly and a side wall or side curtain suspended therefrom are automatically repositioned between a bassinet height and a seat height relative to the seating surface when the seat structure is repositioned between the reclined sleeping position and the inclined seating position, respectively.

18. A convertible child seat according to claim 1, wherein the seat structure and frame assembly can be removably coupled to a frame structure of a child seating device.

19. A convertible child seat according to claim 18, wherein the child seating device is a child swing or a glider.

20. A convertible child seat according to claim 1, wherein the top tube assembly includes a head part coinciding with the seat back portion of the seat structure and a foot part coinciding with the seat bottom portion of the seat structure, and wherein the head part and foot part do not move relative to one another as the top tube assembly moves relative to the seat structure when the seat structure is repositioned.

* * * * *